US005862881A

United States Patent [19]

O'Brien

[11] Patent Number: 5,862,881

[45] Date of Patent: Jan. 26, 1999

[54] SAFETY SCAFFOLD AND PLATFORM LADDERS

[75] Inventor: Sean O'Brien, Dublin, Pa.

[73] Assignee: Keith J. Jeffries, Buckingham, Pa.

[21] Appl. No.: 759,948

[22] Filed: Dec. 2, 1996

[51] Int. Cl.[6] ..... E06C 7/16

[52] U.S. Cl. ..... 182/117; 182/223

[58] Field of Search ..... 182/117, 121, 182/122, 223

[56] References Cited

U.S. PATENT DOCUMENTS

| | | | |
|---|---|---|---|
| 711,384 | 10/1902 | Carman | 182/121 X |
| 747,564 | 12/1903 | Murray | 182/117 |
| 1,841,676 | 1/1932 | Roberts | 182/223 X |
| 3,250,344 | 5/1966 | Romano | 182/223 X |
| 3,282,378 | 11/1966 | Pierce | 182/223 X |
| 3,556,254 | 1/1971 | Lambert | 182/223 |
| 3,734,236 | 5/1973 | Houtler | 182/121 |
| 4,696,373 | 9/1987 | Page | 182/121 |
| 4,730,697 | 3/1988 | Campbell | 182/121 |
| 4,909,351 | 3/1990 | Johnson et al. | 182/121 |
| 4,941,547 | 7/1990 | Livick | 182/117 X |
| 5,005,668 | 4/1991 | Nowlan | 182/121 |
| 5,031,722 | 7/1991 | Renaud | 182/117 |

FOREIGN PATENT DOCUMENTS

| | | | |
|---|---|---|---|
| 215177 | 3/1958 | Australia | 182/122 |
| 1357779 | 3/1964 | France | 182/122 |
| 8703171 | 7/1989 | Netherlands | 182/121 |
| 5344 | 3/1900 | United Kingdom | 182/223 |
| 656901 | 9/1951 | United Kingdom | 182/223 |

*Primary Examiner*—Leslie A. Braun
*Assistant Examiner*—Richard M. Smith
*Attorney, Agent, or Firm*—William F. Hamrock

[57] ABSTRACT

Safety scaffold or platform foldable structures for ladders are disclosed. The scaffold structure embodies an elongated expandable scaffold floor section which is removably connected to two spaced apart upstanding ladders. Male and female floor sections are expanded to the desired length and locked in place by a locking pin. Spaced apart double hook hinges are releasably secured to one rung on each ladder. Wedge mechanisms work in conjunction with the hook hinges engaging the ladder rails to secure the scaffold structure in the horizontal open working position. The platform structure in the form of the letter H is removably connected to two adjacent rungs of a single ladder. The pair of hook arms hook around the upper rung and a pair of bottom arms support the structure on the lower rung. Descending wedge mechanisms engage the ladder rails in supporting the platform structure in the horizontal open working position.

14 Claims, 9 Drawing Sheets

SAFETY SCAFFOLD AND PLATFORM LADDERS

SUMMARY OF THE INVENTION

The invention relates to stable safety scaffold and platform structures for ladders and, more particularly, to a scaffold structure and a platform structure which are releasably attached to the ladders to securely stabilize working positions by being firmly mounted on the rungs of the ladders.

The safety of workers on ladders at a level of more than five feet above the ground requires a safe system that is simple and easy to use and requires less handling. There is a need for an improved low cost safety system for construction workers which provides these advantages. The present invention provides a safe and simple scaffold and platform system for use with ladders which does away with ladder jacks, planks or the need of more than two ladders.

In accordance with the first embodiment of the present invention which is the scaffold structure embodiment, there is provided an elongated scaffold floor structure which is removably connected to two spaced apart upstanding ladders. The scaffold structure provides a scaffold flooring which is slidably expanded in various lengths by male and female floor sections which are locked together by a locking pin inserted within opposing aligned openings therein. Spaced apart hinges at each ladder end of the joined male and female sections hook onto a rung on each ladder permitting swinging up and down movement of the scaffold structure so that it can be folded up on the ladders in ascending and descending therefrom. Wedge mechanisms are secured downwardly at an angle to the scaffold flooring below the hinges to work in conjunction with the hinges in securing the structure in the open working position. The wedge mechanisms engage the ladder rails to secure the scaffold flooring in a horizontal position allowing the workers to stand safely on the scaffold flooring.

In accordance with the platform structure embodiment of the present invention, there is provided a stable safety structure for a ladder to safely support a worker on the ladder. The platform is removably connected to a single ladder and will support an individual worker thereon. The platform includes a flat platform support in the form of the letter H having a flat platform cross section. A pair of hinge arms hook around an upper rung of the ladder and a pair of bottom supports are supported on the adjacent bottom rung which permit swinging up and down movement of the platform structure so that it can be folded up on the ladder. Descending wedge mechanisms are secured downwardly at an angle of the platform support below the hinge arms. The wedge mechanisms engage the ladder rails to secure the platform support in a horizontal position allowing the worker to stand safely on the platform support.

DETAILED DESCRIPTION OF THE PREFERRED EMBODIMENT

The unique safety scaffold and platform structures embodiments disclosed herein are not merely another complicated scaffold or platform structure for workers to stand on when working with ladders. To the contrary, the unique safety scaffold and platform structures perform several functions in a safe manner not previously obtainable from previous scaffolds and platforms. The unique combination of hinges and wedges on the scaffold and platform permits quick and easy installing and removing of the structures on and from the ladder as well as provides a safe and stable work areas. Also the structures are easily folded up to a vertical position on he ladder by the worker which provides a safe procedure of climbing up and descending from the ladder.

Figure 1:
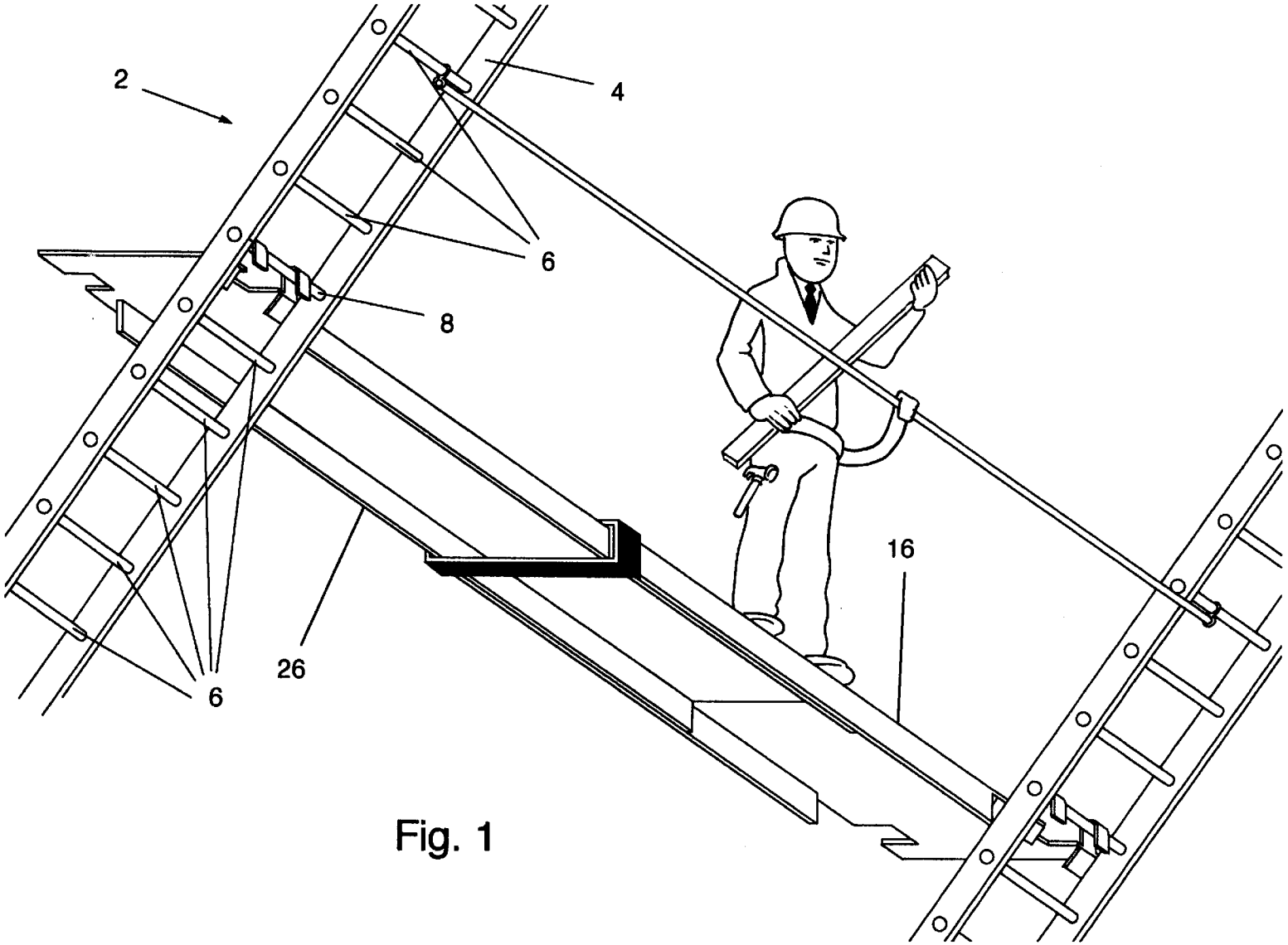
FIG. 1 is a perspective view partly in sections of the safety scaffold structure embodiment mounted to two ladders.
Figure 6:
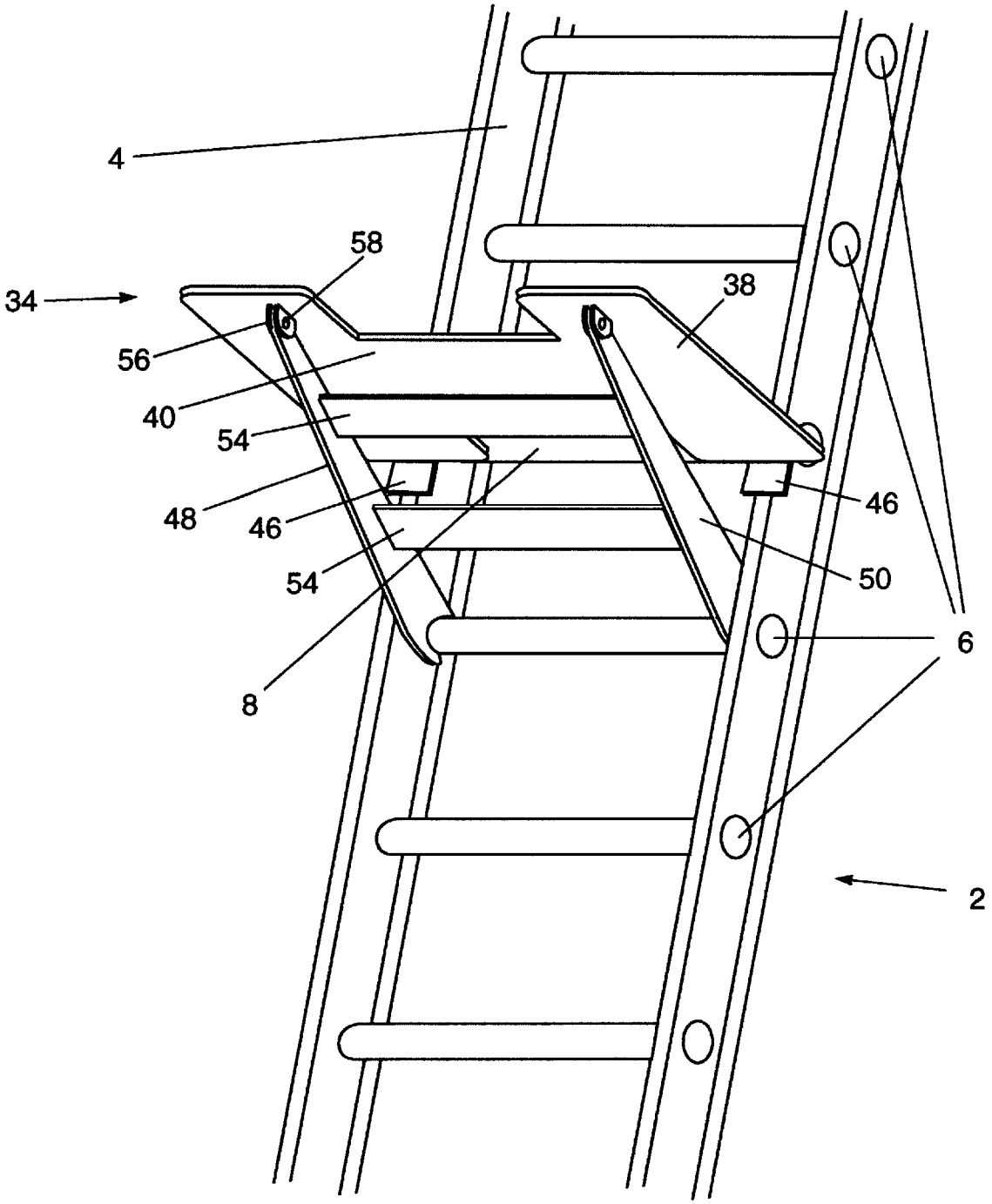
FIG. 6 is a perspective view partly in section of the safety platform structure embodiment mounted to a ladder.

The present safety scaffold structure embodiment and platform structure embodiment are used with conventional upstanding ladders which lean against a wall or building to be worked. In FIG. 1, there is shown a sectional view of the safety scaffold structure 10 secured to spaced apart ladders 2 in the open working position which is generally horizontal position with respect to the ground. The ladders have vertical side rails 4 and a plurality of successively spaced horizontal rungs 6. Rung 8 is located generally about five rungs from the top of the ladder which has been found to be the most convenient working location for the workers on the scaffold. The angle formed by the ladder leaning against the wall or building is generally about seven degrees more or less which appears to be the preferred and safest working position with ladders. The platform structure or embodiment as seen in FIG. 6 will be discussed subsequently to the scaffold structure embodiment.

Figure 3:
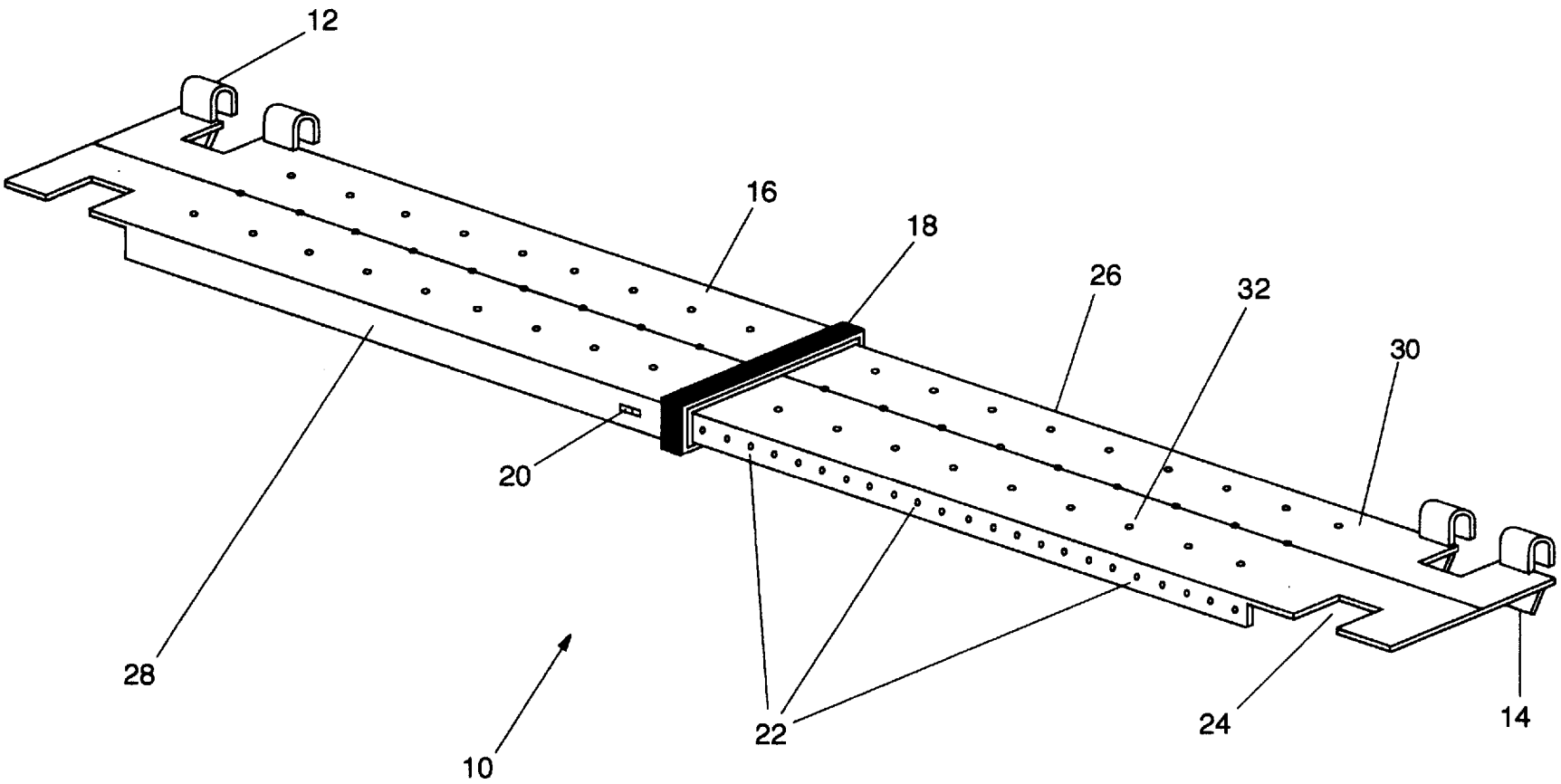
FIG. 3 is a perspective view of the safety scaffold structure embodiment.

Referring now to the drawings, shown in FIG. 1 is scaffold structure 10 in use removably attached at each end to two spaced apart ladders standing upright against a wall ( not shown). The scaffold structure 10 as seen in FIG. 3 includes an expandable scaffold flooring having a flat top surface of substantially rectangular shape and sufficient surface area upon which one or more workers can stand. The expandable scaffold flooring can be structured from any expandable flat material such as heavy duty aluminum or may be structured from expandable sections of material of heavy duty aluminum or similar material as shown in the drawings.

Figure 4:
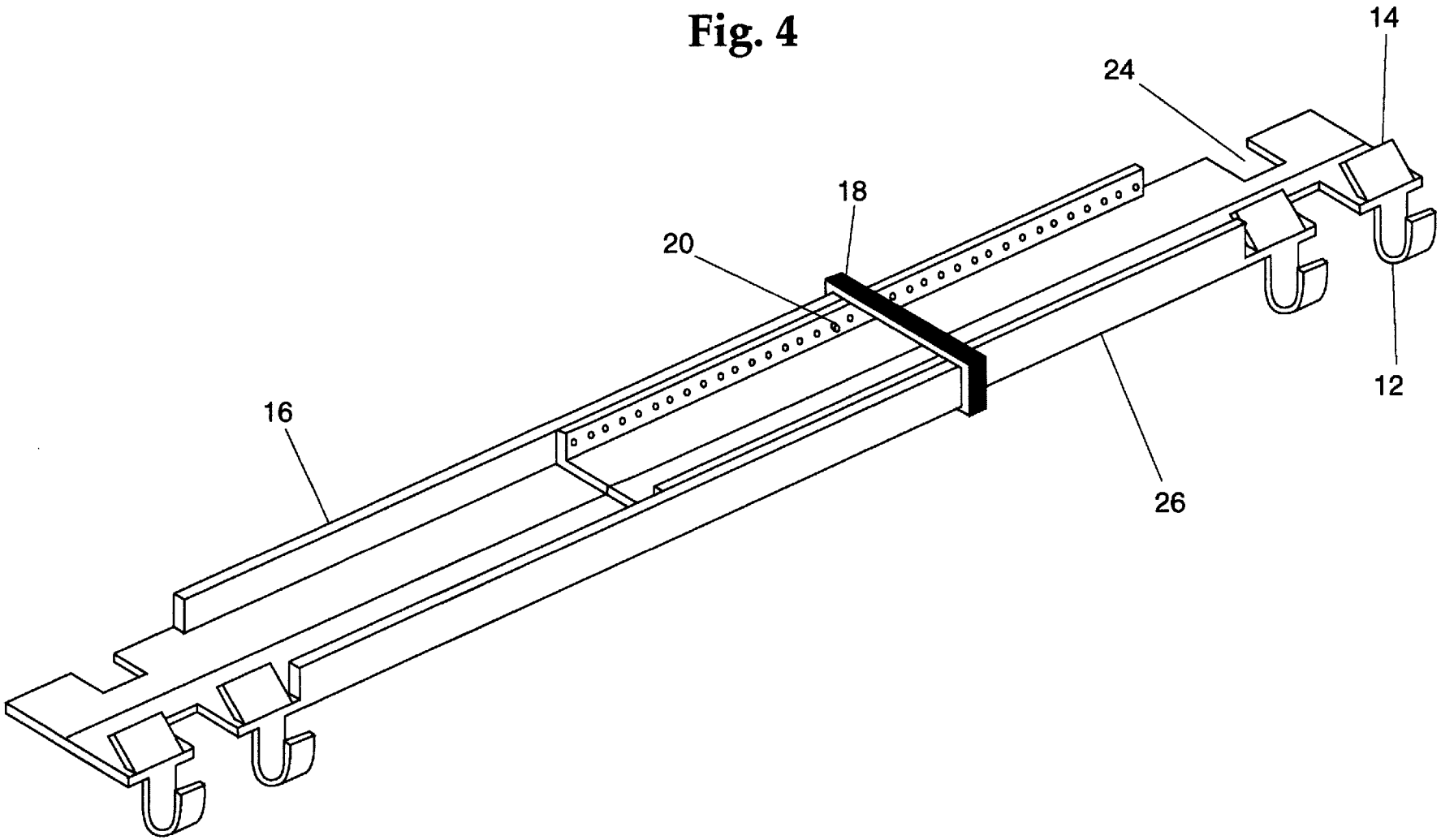
FIG. 4 is a bottom view of the safety scaffold structure embodiment.

As seen in FIGS. 1, 3 and 4, a preferred scaffold flooring includes female floor section 16 and male floor section 26. The male section is the expandable section of the scaffold structure which slides into the female section and is releasably secured therein by locking pin 20. Each floor section 16 and 26 includes front and rear side sections 28 extending downwardly. Mounted on the front side section of the female floor section 16 is the locking pin 20 while male floor section 24 has a plurality of laterally spaced apart small pin holes 22 extending along its front side section. As shown in FIG. 4, after the male floor section is set into the female floor section, locking pin 20 about one inch in length is inserted within the aligned small pin hole 22 of the male floor section to lock the two floor sections together. A locking ring 18 made of a band of durable metal or plastic preferably a band of heavy duty aluminum encompasses the interior end of the female floor section and clamps the female floor section firmly around the embedded male floor section to firmly support the floor sections joined together. Preferably, the male floor section 26 is set into the female floor section until the desired length of expansion of the scaffold structure is obtained and is then locked therein by securing the locking pin in the pin hole.

Referring to FIGS. 1, 2, 2A, 3 and 4, located slightly in from each exterior end on the rear side of the female flooring section 16 and male flooring 26 are a pair of laterally spaced hinges 12 separated by rear cut-away opening 24. Mounted below each hinge 12 is wedge mechanism 14 extending inwardly and downwardly from the hinge at an angle The wedge mechanism 14 is made of durable metal or other durable material preferably heavy duty aluminum which is securely joined to the structure either to the hinge or side section by extrusion, welding, riveting or other practical means. There is also in the front floor sections an opposing front cut-away opening 24 and thus the four cutaway openings allow a worker's foot to pass through these front and rear openings when climbing the ladder when the scaffold structure is swung up in the folded position on the ladder as seen in FIG. 5.

Figure 2:
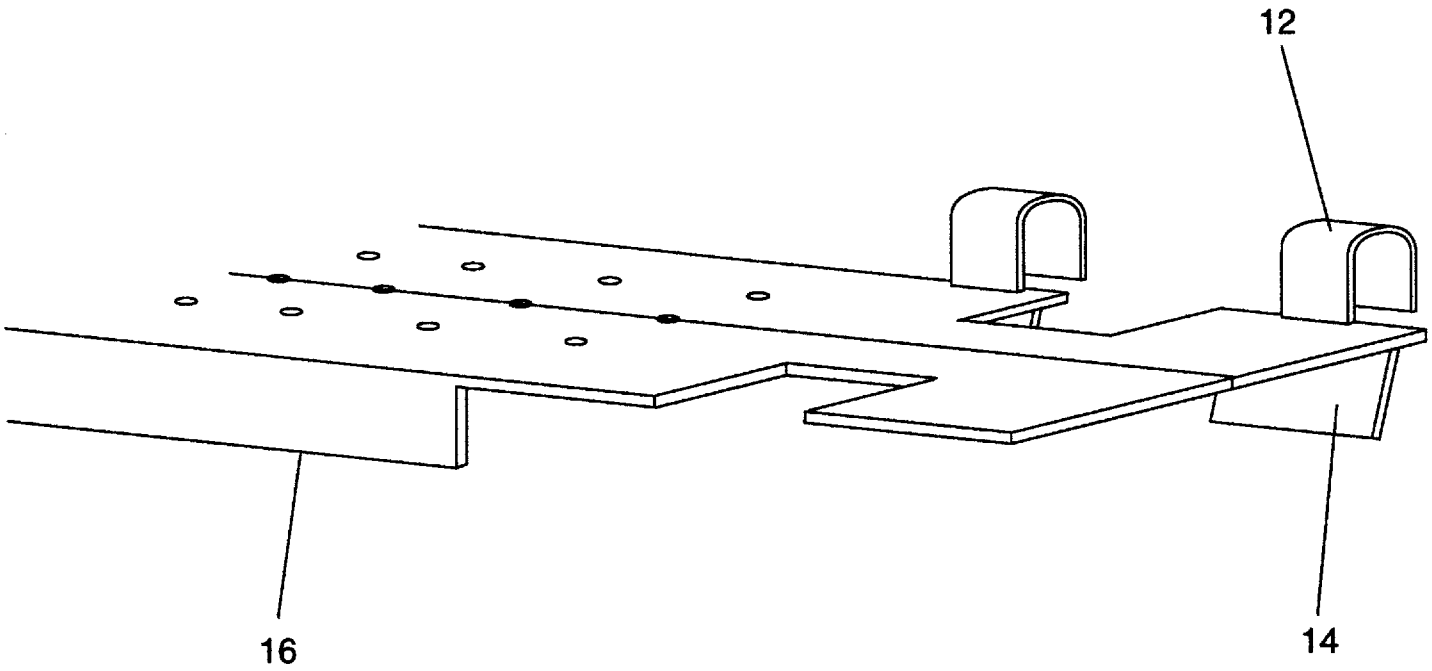
FIGS. 2 and 2A are sectional views of the female floor section.
Figure 2A:
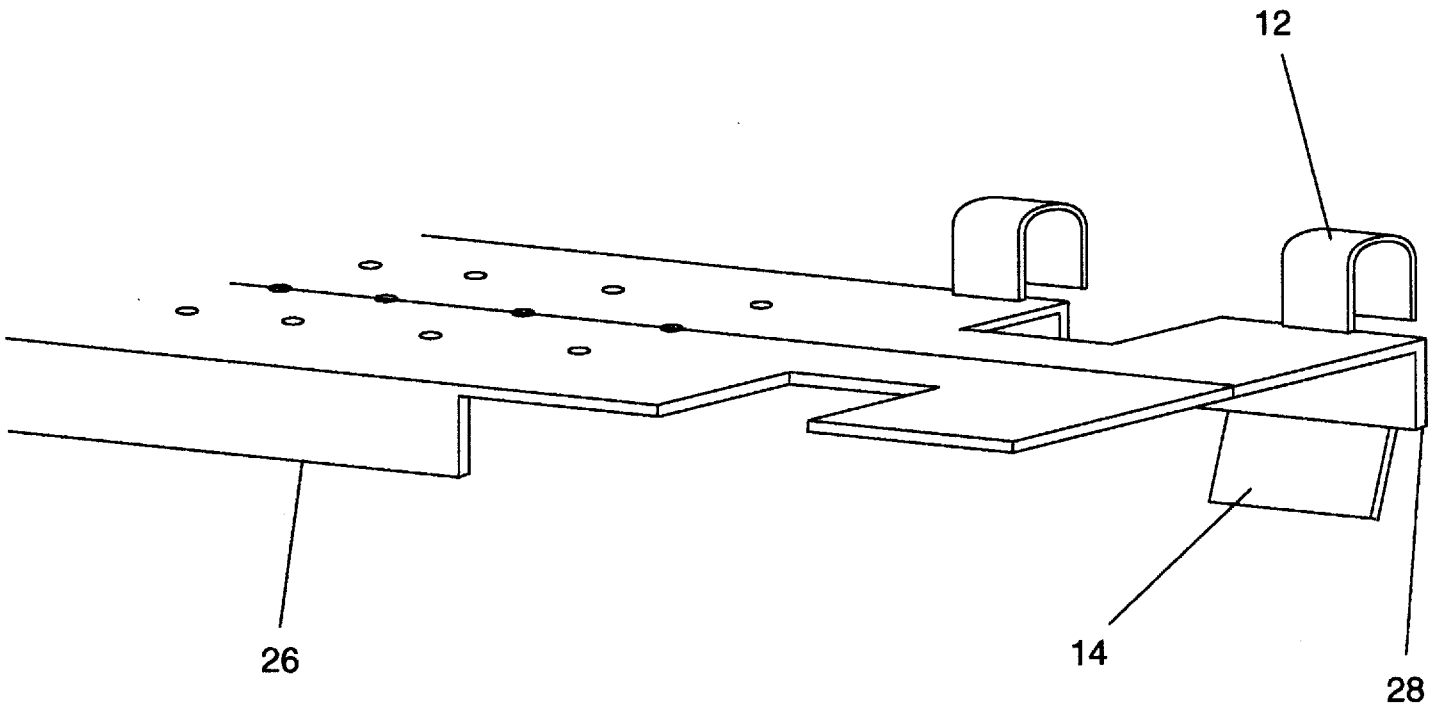
Figure 5:
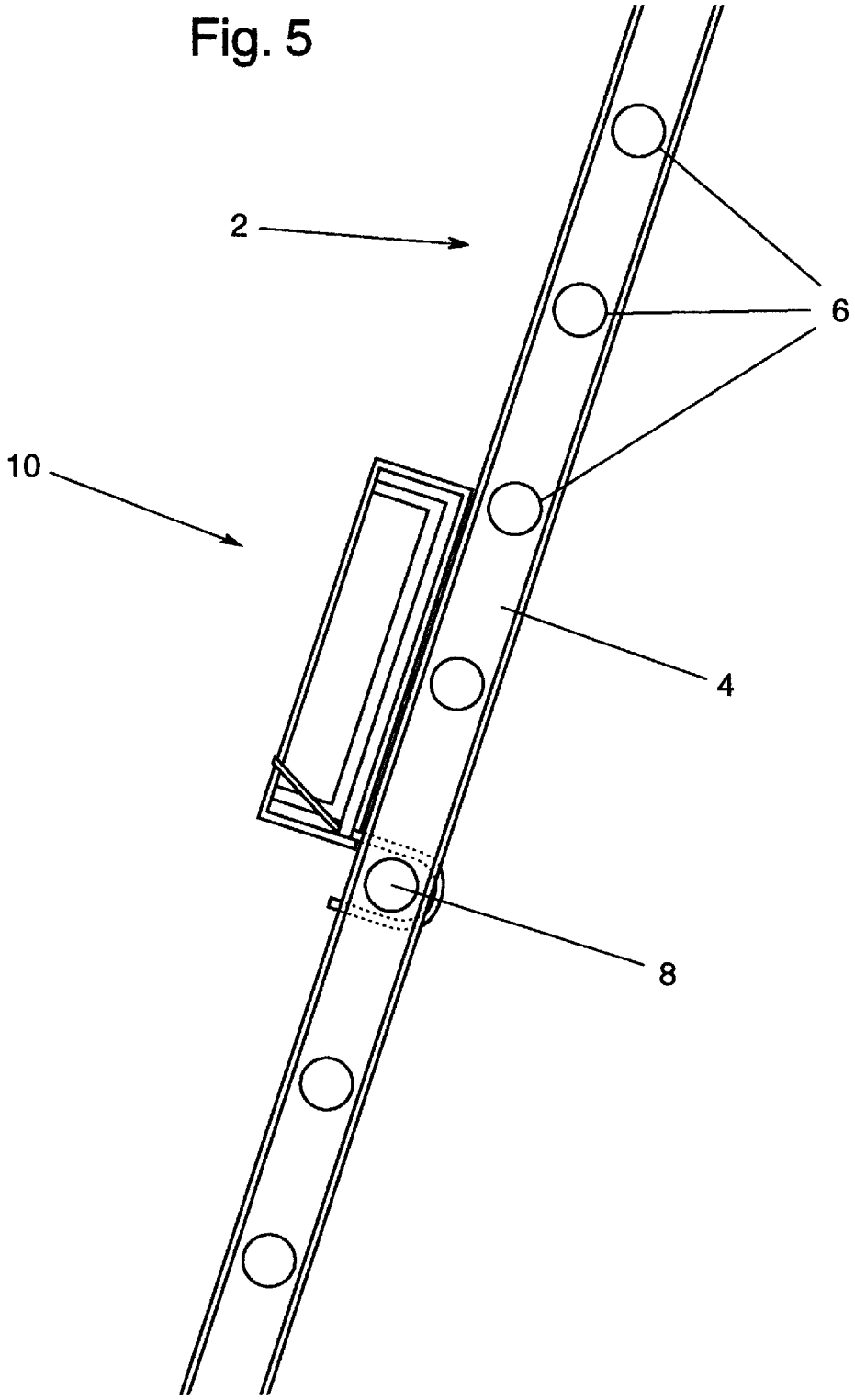
FIG. 5 is a side view of the safety scaffold structure embodiment folded up on a ladder.

The unique hinge 12 and wedge mechanism 14 configuration of the invention permits the scaffold structure 10 to be easily manipulated on the ladder as shown in FIG. 5 to securely fold up the scaffold structure to the ladder in the vertical position hinges 12 include hinge arms which form a U-shaped hook which encircles rung 8 of the ladder. The hinges are secured to the floor sections to hook around rungs 8 just inside each side rail 4 up to about one inch inside the rail resulting in a space of about eight inches between the hinges. Wedge mechanism 14 extends downwardly at an angle as seen in FIG. 2 and FIG. 2A on the rail side of each hinge to firmly engage the rails when the scaffold is in the open working position on the ladders as shown in FIG. 1. The angle of the wedge mechanism extending downwardly below the hinges is preferably about seven degrees which is similar to the preferred angle in which the ladder is placed against a wall or building. It is this unique configuration of the U-shaped hinges securely encircling the rung of the ladder and the wedge mechanism, set at a descending angle firmly engaging the ladder rails which fixedly supports the scaffold structure secured to the ladder at a uniform flat horizontal level. Generally, the dimensions of wedge mechanism 14 found satisfactory are about five inches in width and about four inches in height. However, the descending angle and the dimensions depend upon the variables of the scaffold structure and the work operation and may be changed to fit the situation.

Shown in FIG. 2 and FIG. 2A is the attachment of the wedge mechanism 14 to the scaffold floor section in FIG. 2 and to the rear side section 28. The descending angle of the wedge mechanism is set to coincide with the angle of the ladder against the wall or building.

As shown in FIG. 5 is a side view of the safety scaffold structure 10 in the closed nonworking position supported by the hinge on rung 8 on the ladder. The scaffold structure is placed in the closed position on the two ladders by a worker on each ladder working together.

In operation, the two workers space the two ladders apart generally about sixteen feet leaning against the wall or building. The male floor section 26 is then inserted within the female floor sections 16 and locking ring 18 to a point where hinges 12 coincide with the rungs of the ladders. Upon reaching the desired length, the locking pin 20 is inserted within the aligned pin hole 22 to lock the male and female sections together. Each worker holds the scaffold structure in the folded up position at one end proceeding then up the ladders to the desired height which is preferably about five rungs from the top. Upon reaching the desired height on the ladder, the workers mount the hinges on the rung folding up the scaffold structure leaning against the rails of the ladders. The worker then proceeds upwardly stepping within the front and rear cut-away openings 24 on the floor sections 16 and 26 to a higher ladder rung 6 above rung 8. While supported on the higher rung 6 each worker moves the scaffold structure with his foot allowing the structure to unfold by gravity downwardly into the open horizontal position with the hinges 12 hooking around rung 8 and the wedge mechanism 14 locking into position on the ladder rails 4. The workers then walk out on the scaffold.

Preferred scaffold flooring sections are shown in FIGS. 2, 2A, 3 and 4. Each female floor section 16 and male floor section 26 includes two rectangular floor elements 30 preferably manufactured with heavy duty aluminum about one quarter of an inch in thickness. All floor elements are riveted together forming the flat flooring 32 as shown. Other methods of manufacturing the floor sections in accordance with the present invention are acceptable.

Generally, the following dimensions are applicable for the safety scaffold structure of the present invention: scaffold structure 10 about sixteen inches in width and about fifteen to fifty feet in length, each female section ten to thirty feet in length or less; female sides 28 about five to six inches high and male sides 28 about four and three quarters to five and three quarters inches high wherein the sides generally enclose up to about one foot from the exterior end of the floor section; cut-away sections about five inches in width and about three and one half inches deep; locking pin 20 about one inch in length and about one quarter inch in diameter heavy duty aluminum or other workable material. Preferably all materials are made from heavy duty ladder grade aluminum alloy or equivalent material. The scaffold structure can be manufactured from a few extrusions which are secured together.

Figure 8:
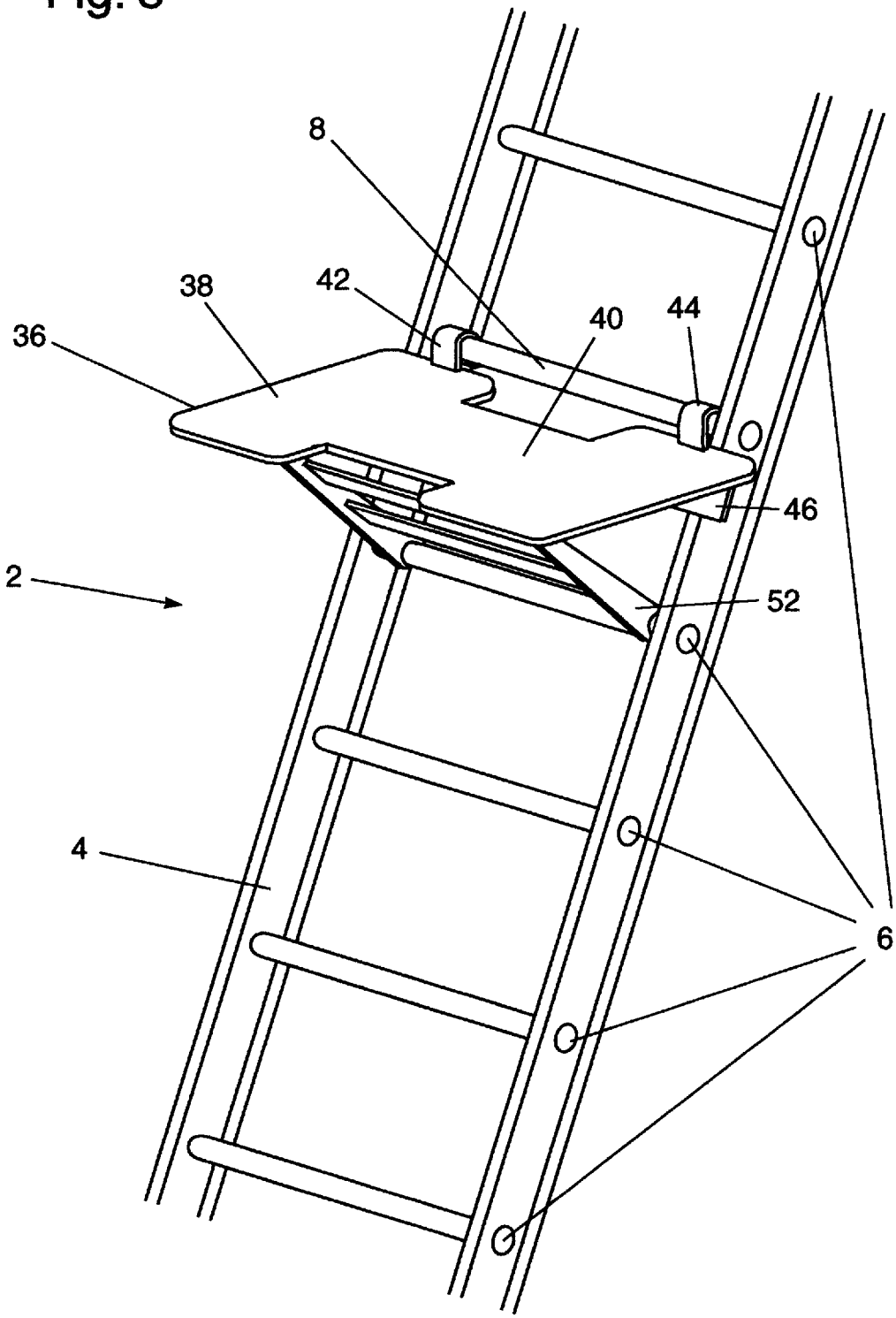
FIG. 8 is another perspective view partly in section of the safety platform structure embodiment on a ladder.

The second preferred embodiment of the invention is the safety platform structure embodiment. Stable platform structure 34 is shown in FIGS. 6 and 8 removably supported in its open position on the two adjacent rungs 8 and 6 of the ladder 2. Platform structure 34 is preferably made of ladder grade cast aluminum about one half inch in thickness or any other suitable material. Platform structure 34 includes flat platform section 36 in the form of the letter H having two platform side sections 38 and platform cross sections 40. Extending from the front end of side sections 38 are a pair of hinge arms 42 each of which terminates in a hook member 44 having its outward side extending downwardly. Mounted below each hook member 44 is wedge mechanism 46 extending inwardly and downwardly therefrom. The wedge mechanism is made of durable metal or other durable material preferably heavy duty aluminum which is securely joined to the platform structure either to the hinge arms 42 or side sections 38 by extrusion, welding riveting or other practical means. Hingedly attached to the rear of the side sections 38 is bottom support having a pair of support arms 50 extending downwardly forming an arcuate shaped locking shank 52. A pair of parallel cross supports 54 extend between support arms to firmly secure the support arms together. Hinge connector 56 may be connected by bolts 58 or the link to hingedly attach support arms 50 to the platform side sections 38.

As seen in the open position in FIGS. 6 and 8, stable safety platform 34 is in the working position supported on the two adjacent rungs 8 and lower rung 6 on the ladder. Flat platform section 36 is supported in the generally horizontal position with respect to the ground by hook members 44 in the front and by bottom support 48 in the rear. Hook members 44 lock platform section 36 to the ladder by extending over the top of rung 8 with the outer side of the hook member extending downwardly below the rung. Hinge arms 42 are located just inside each side rail section 4. Wedge mechanism 46 extends downwardly at an angle on the rail side of each hook member firmly engaging the rails when the platform structure 34 is in the open working position on the ladder 2 as seen in FIGS. 6 and 8. The angle of the wedge mechanism 46 extending downwardly below hinge arms 42 is preferably about seven degrees which is similar to the preferred angle in which the ladder is placed against a wall or a building. As in the scaffold structure embodiment it is this unique configuration of the hook arm 42 and hook member 44 securely encompassing rung 8 of the ladder and wedge mechanism 46 set at a descending angle firmly engaging the ladder rails fixedly supporting the platform structure secured to the ladder at a uniform flat horizontal level.

Bottom support 48 further locks platform structure 34 to the ladder by means of support arms 36 swinging downwardly and inwardly to clamp locking shank 52 onto the adjacent lower rung 6. The length of support arms 50 should be long enough to support platform structure 34 in a generally horizontal position with respect to the ground.

Figure 7:
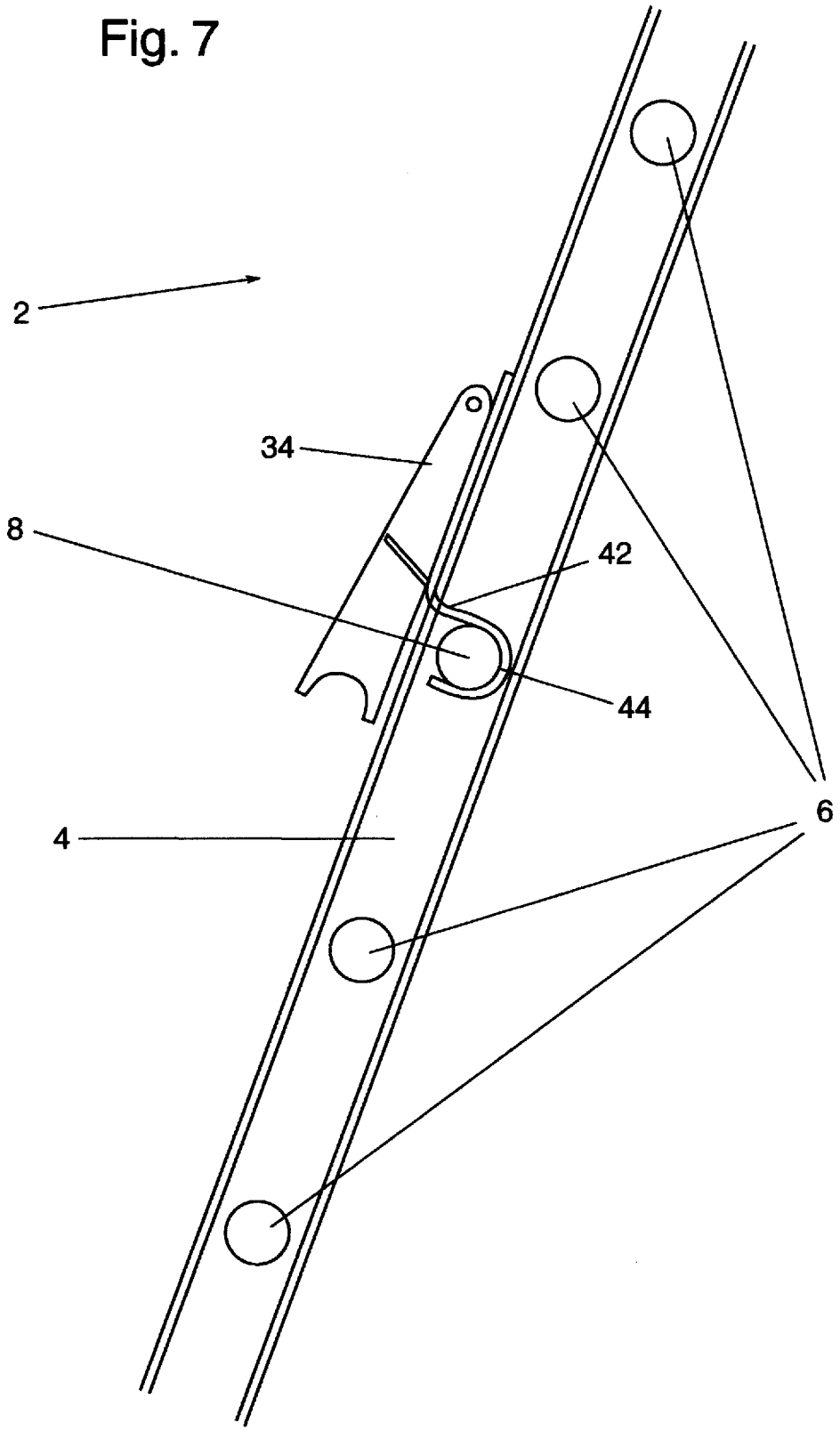
FIG. 7 is a side view of the safety platform structure embodiment folded up on a ladder.

As seen in FIG. 7, safety platform structure 34 is in the closed nonworking position on the ladder. The platform structure is placed in the folded up position from the open position by removing locking shanks 52 from being locked onto the adjacent rung 6. Then, flat platform section 36 swing upwardly so that platform side sections 38 lie flat against the side rails 4 partly above rung 8 with hook member 44 sliding around rung 8. Concurrently, therewith, hingedly attached support arms 50 swing up to lie adjacently on the underside of flat platform section 36. In this position, platform structure 34 is in the closed position, the worker is able to climb the ladder without difficulty stepping through the open H sections to a higher rung. In order to manipulate the safety platform to the open position, the worker ascends the ladder to a higher rung 6 and then gently pushes the platform structure with his foot allowing the structure to unfold by gravity downwardly into the open position moving the hinge arms 42 to swing hook members 44 around rung 8 and wedge mechanism 46 to encounter the rails causing locking shank 52 to lock onto lower adjacent rung 6.

Generally, platform structure 34 is about twenty one inches in width to extend beyond each side of the ladder. The combination of the H shaped platform, hinge arms and hook members, wedge mechanism and the bottom support stabilize the platform structure so that the worker becomes less fatigued by being able to stand up straight the worker is then able to increase productivity and improve the quality of the work.

Having now described the invention, it will be apparent to one of ordinary skill in the art that many changes and modifications can be made thereto without departing from the spirit and scope of the invention as set forth herein.

What is claimed is:

1. A scaffold structure for ladders with rungs and side rails for workers to stand on comprising a foldable, expandable scaffold structure releasably mountable on one rung of each of two spaced apart ladders, said scaffold structure having an expandable flooring means rectangular in shape, hook means comprising spaced apart double hook elements provided at each end of the flooring means releasably mountable on one rung of each ladder, wedge stop means extending downwardly and inwardly directly below each of said hook elements at an angle aligned to engage said side rails adjacent said one rung.

2. The scaffold structure according to claim 1 wherein said flooring means has a downwardly extending side means upon which said wedge stop means are mounted.

3. The scaffold structure according to claim 1 wherein said wedge stop means are mounted on said flooring means.

4. The scaffold structure according to claim 1 wherein said hook elements are U-shaped.

5. The scaffold structure according to claim 1 wherein said flooring has opposing cut-away foot openings at each end located between the double spaced hook elements.

6. The scaffold structure according to claim 1 wherein said flooring means comprises expandable male and female sections joined together at their interior ends.

7. The scaffold structure according to claim 6 wherein said male and female sections are releasably joined together by a locking pin.

8. The scaffold structure according to claim 7 wherein said male section has a plurality of laterally spaced apart locking pin holes which receive said locking pin.

9. The scaffold structure according to claim 8 wherein said female section has said locking pin attached thereto.

10. The scaffold structure according to claim 9 wherein a locking band encompasses the interior end of the female section.

11. The scaffold structure according to claim 1 wherein said scaffold structure is made of heavy duty aluminum.

12. The scaffold structure according to claim 6 wherein each of said male and female sections comprises two opposing rectangular subsections joined together.

13. The scaffold structure according to claim 2 wherein the angle of the wedge stop means extending downwardly is about equivalent to an angle of the ladders standing upright leaning against a wall or vertical support.

14. The scaffold structure according to claim 13 wherein said angle is about seven degrees.

* * * * *